US007997514B2

(12) United States Patent
Yang

(10) Patent No.: US 7,997,514 B2
(45) Date of Patent: Aug. 16, 2011

(54) METHOD FOR FABRICATING CIGS NANOPARTICLES

(75) Inventor: Yi-Lang Yang, Zhongli (TW)

(73) Assignee: Jenn Feng New Energy Co., Ltd., Taoyuan (TW)

( * ) Notice: Subject to any disclaimer, the term of this patent is extended or adjusted under 35 U.S.C. 154(b) by 193 days.

(21) Appl. No.: 12/566,915

(22) Filed: Sep. 25, 2009

(65) Prior Publication Data

US 2011/0073688 A1 Mar. 31, 2011

(51) Int. Cl.
*B02C 17/00* (2006.01)

(52) U.S. Cl. ..... 241/16; 241/29

(58) Field of Classification Search ..... 241/16, 241/29

See application file for complete search history.

(56) References Cited

U.S. PATENT DOCUMENTS 7,448,561 B2 * 11/2008 O'Connor et al. ..... 241/1

* cited by examiner

*Primary Examiner* — Faye Francis
(74) *Attorney, Agent, or Firm* — Rabin & Berdo, P.C.

(57) ABSTRACT

A wet ball mill method for fabricating copper/indium/gallium/selenium (CIGS) nanoparticles, comprising an individual milling process, a homogeneously mixing process, a primary milling process, and an advanced milling process, wherein in the individual milling process, the individual particles or compound particles including copper, indium, gallium and/or selenium are milled to the individual milled materials with a particle size 500 nm to 600 nm; in the homogeneously mixing process, the individual milled materials are mixed to a mixed homogenate; in the primary milling process, the mixed homogenate is milled to the primary milled materials with particle size 100 nm to 200 nm; and in the advanced milling process, the primary milled materials are milled to the advanced milled materials with particle size less than 50 nm which are the CIGS nanoparticles for fabricating the absorption layer of CIGS solar cell.

12 Claims, 1 Drawing Sheet

METHOD FOR FABRICATING CIGS NANOPARTICLES

BACKGROUND OF THE INVENTION

1. Field of the Invention

The present invention relates to a method for fabricating copper/indium/gallium/selenium (CIGS) nanoparticles, and more particularly, to a wet ball mill method using zirconia beads.

2. The Prior Arts

Nanoparticles generally means particle with size smaller than 100 nm, and the transition from microparticles to nanoparticles can lead to a number of changes in, such as optical, thermal, magnetic and mechanical properties.

When gold is split into the particle with size smaller than the wavelength of light, gold loses the originally wealthy luster and renders black for its special optical properties. For examples, silvery-white platinum becomes black platinum black in the nano size and golden chromium becomes black chromium in the nano size. Actually, all the metal render black in the nanoparticle size and the color becomes blacker with smaller size. Therefore, nanoparticles have lower reflectivity and higher light absorbance.

Under the global consciousness of green and environmental protection to save power consumption and reduce carbon dioxide emission, CIGS solar cell has no material shortage problem as the silicon solar cell depends on silicon wafer excessively, and also no high material cost problem as dye-sensitized solar cell (DSSC) requires the photosensitized dyes. In addition, the optimal photoelectric conversion efficiency of CIGS solar cell can achieve to 25%, and the photoelectric conversion efficiency of flexible plastic substrate has achieved to 14% such that CIGS solar cells possess a high development potential for the future.

The CIGS solar cell generally comprises an absorption layer as a p-type layer and a zinc sulfide (ZnS) layer as a n-type layer, wherein the absorption layer is the copper indium gallium diselenide ($Cu(In,Ga)Se_2$) layer and the light-absorption efficiency of the absorption layer influences the photoelectric conversion efficiency of CIGS solar cell directly.

Recently, a lot of methods for fabricating CIGS nanoparticles was brought out for preparing the absorption layer with high light absorbance, including physical methods and chemical methods, wherein the physical methods comprise vapor condensation, mechanic ball mill method, physical crumbling, thermal disintegrating and supercritical fluid, and the chemical methods comprise chemical vapor deposition, sol-gel, microemulsion, polymer graft, hydrothermal synthesis, arc plasma, and sonochemical methods. Mechanic ball mill method has better economy benefit so that mechanic ball mill method has development potential, especially to wet ball mill method which uses liquid as a mediator between milling ball and the materials-being-milled for increasing the milling efficiency.

The disadvantages of the prior arts are that the wet ball mill method needs to use the high energy and high precision apparatus, and the wet ball mill method is limited by the original particle size and the properties of individual materials-being-milled, and thereby the range of the particle sizes and homogeneity of CIGS particles can not be controlled precisely at one time and thus consumes a lot of energy. Accordingly, a multi-stage milling method is required. The multi-stage milling method is that the individual materials are first milled to produce the individual milled materials which have specific size and maintain their original physical properties and surface state, and then the different individual milled materials are homogeneously mixed together, and the size of milling ball is reduced step by step in the two-stage milling process so that the particle sizes of CIGS particles can be reduced to the desired range to eliminate the disadvantages of the prior arts.

SUMMARY OF THE INVENTION

The objective of the present invention is to provide a wet ball mill method for fabricating CIGS nanoparticles, which comprises: individual milling process, homogeneously mixing process, primary milling process, and advanced milling process, wherein in the individual milling process, the individual particles or the compound particles including copper, indium, gallium and/or selenium are milled to the individual milled materials with a particle size 500 nm to 600 nm, and in the homogeneously mixing process, the individual milled materials are mixed to the mixed homogenate, and in the primary milling process, the mixed homogenate is milled to the primary milled materials with a particle size of 100 nm to 200 nm, and in the advanced milling process, the primary milled materials are further milled to the advanced milled materials with a particle size less than 50 nm, and the advanced milled materials with a particle size less than 50 nm are the CIGS nanoparticles used for fabricating the absorption layer of CIGS solar cell.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1:
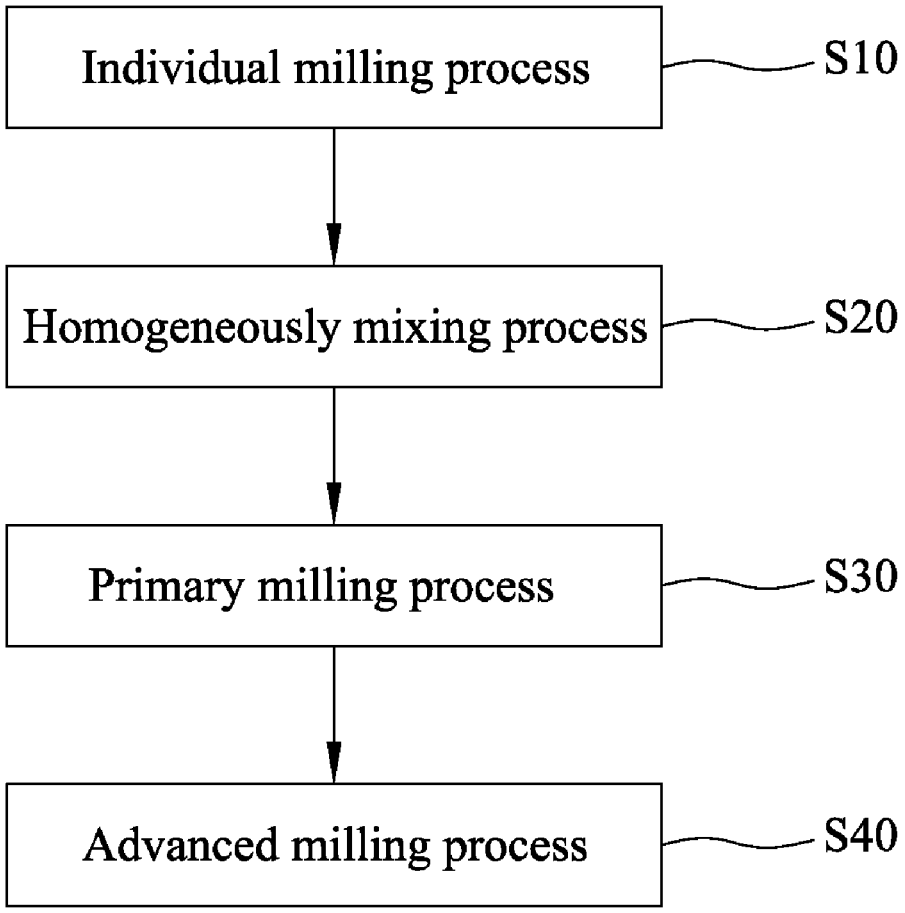
FIG. 1 is a flow chart illustrating a method for fabricating CIGS nanoparticles of the present invention.

The accompanying drawings are included to provide a further understanding of the invention, and are incorporated in and constitute a part of this specification. The drawings illustrate embodiments of the invention and, together with the description, serve to explain the principles of the invention.

Referring to FIG. 1, the flow chart illustrating a method for fabricating CIGS nanoparticles of the present invention. As shown in FIG. 1, by starting at step S10, an individual milling process is performed in step S10, in which a plurality of the materials-being-milled are milled for 4 to 6 hours by using a first milling mediator, and a first milling solvent in a milling machine in order to produce a plurality of individual milled materials, wherein the first milling mediator can be the zirconia beads, and especially the zirconia beads with a diameter size of 1.0 mm to 2.0 mm, used as milling balls. The first milling solvent can be at least one of water, alcohols, esters and ketones. The materials-being-milled can be particles or compounds including copper, indium, gallium, or/and selenium, for example, copper selenide, indium selenide, and gallium selenide. The first milling mediator, the first milling solvent and the materials-being-milled are put in the milling machine, the first milling mediator has a volume percentage of 50% to 95%, and the individual materials-being-milled have a volume percentage of 5% to 80%.

The driving device of the milling machine is generally rotated to cause the first milling mediators to collide one against another, rotate, and move relative to one another, which impart the high energy density of collision force, frictional force, and shearing force to the materials-being-milled so that the materials-being-milled among the first milling mediators are milled to the individual milled materials with a particle size 500 nm to 600 nm.

Proceeding from S10 to S20, a homogeneously mixing process is performed, in which the individual milled materials are all homogeneously mixed together for 1 to 4 hours by using the homogenizing solvent containing the binder and the surfactant in the homogenizing machine in order to produce a mixed homogenate. The homogenizing machine can be a three-dimension mixing machine, and the homogenizing solvent can be at least one of water, alcohols, esters, and ketones.

Proceeding from S20 to S30, a primary milling process is performed, in which the mixed homogenate is further milled for 1 to 12 hours using a second milling mediator, a second milling solvent, and a dispersant in the milling machine in order to produce the primary milled materials with a particle size of 100 nm to 200 nm. The second milling mediator can be the zirconia beads with a diameter size of 0.4 mm to 1.0 mm. The second milling solvent can be at least one of water, alcohols, esters, and ketones. The dispersant is the polymer dispersant or the non-ion type dispersant, which can be at least one of alkybenzoyl sulfonate, sulfate, sulfoglycerin phosphate, amino acid salt, phosphatide, taurinate, phosphate, alkysulfate, fatty acid, polyethylene oxide (PEO) thioalcohol, glucitol, and quaternary ammonium. The second milling mediator has a volume percentage of 50% to 95%, and the mixed homogenate has a volume percentage of 5% to 80%.

Proceeding from S30 to S40, an advanced milling process is performed, in which the primary milled materials are further milled for 1 to 12 hours using a third milling mediator, a third milling solvent, and the above-mentioned dispersant in the milling machine in order to produce the advanced milled materials with a particle size less than 50 nm, and the advanced milled materials is the CIGS nanoparticles. The third milling mediator can be the zirconia beads with a diameter size of 0.05 mm to 0.4 mm. The third milling solvent can be at least one of water, alcohols, esters, and ketones. The third milling mediator has a volume percentage of 50% to 95%, and the primary milled materials have a volume percentage of 5% to 80%.

In the milling solvent described above, the water can be pure water, deionized water or mixture thereof; the alcohols can be methanol, ethanol, ethylene glycol, propanol, isopropyl alcohol, propylene glycol, butanol or mixture thereof; the esters can be ethyl ester, vinyl acetate, ethyl acetate, butyl acetates, propyl acetate, amyl acetate, methyl acetate dichloride, methyl crotonate, or mixture thereof; and the ketones can be acetone, butanone, cyclohexanone, 2-pentanone, 3-pentanone, or mixture thereof.

The CIGS nanoparticles produced by the wet ball mill method of the present invention can be used to fabricate the absorption layer of CIGS solar cell for increasing the photoelectric conversion efficiency of CIGS solar cell and reducing the manufacturing cost.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A method for fabricating copper/indium/gallium/selenium (CIGS) nanoparticles, comprising the steps of:

an individual milling process, a plurality of materials-being-milled being milled by using a first milling mediator and a first milling solvent in a milling machine to produce a plurality of individual milled materials, wherein the materials-being-milled comprises particles including copper, indium, gallium, and/or selenium, and compounds including copper selenide, indium selenide and gallium selenide, and a particle size of the individual milled materials is 500 to 600 nanometer (nm);

a homogeneously mixing process, the individual milled materials being mixed by using a homogenizing solvent comprising a binder and a surfactant in a homogenizing machine to produce a mixed homogenate;

a primary milling process, the mixed homogenate being milled by using a second milling mediator, a second milling solvent and a dispersant in a milling machine to produce primary milled materials with particle size 100 nm to 200 nm;

an advanced milling process, the primary milled materials being milled by using a third milling mediator, a third milling solvent and the dispersant in a milling machine to produce advanced milled materials with particle size less than 50 nm, the advanced milled materials being CIGS nanoparticles.

2. The method according to claim 1, wherein the first milling mediator in the individual milling process is zirconia beads with a diameter size of 1.0 mm to 2.0 mm and has a volume percentage of 50% to 95%, and a milling time for the individual milling process is 4 to 6 hours.

3. The method according to claim 1, wherein the first milling solvent in the individual milling process comprises at least one of water, alcohols, esters and ketones.

4. The method according to claim 1, wherein the materials-being-milled in the individual milling process have a volume percentage of 5% to 80%.

5. The method according to claim 1, wherein the homogenizing solvent in the homogeneously mixing process comprises at least one of water, alcohols, esters and ketones, and a homogeneously mixing time for the homogeneously mixing process is 1 to 4 hours.

6. The method according to claim 1, wherein the second milling mediator in the primary milling process is zirconia beads with a diameter size of 0.4 mm to 1.0 mm and has a volume percentage of 50% to 95%, and a milling time for the primary milling process is 1 to 12 hours.

7. The method according to claim 1, wherein the mixed homogenate in the primary milling process has a volume percentage of 5% to 80%.

8. The method according to claim 1, wherein the second milling solvent in the primary milling process comprises at least one of water, alcohols, esters, and ketones.

9. The method according to claim 1, wherein the third milling mediator in the advanced milling process is zirconia beads with a diameter size of 0.1 mm to 0.4 mm and has a volume percentage of 50% to 95%, and a milling time for the advanced milling process is 1 to 12 hours.

10. The method according to claim 1, wherein the third milling solvent in the advanced milling process comprises at least one of water, alcohols, esters, and ketones.

11. The method according to claim 1, wherein the primary milled materials in the advanced milling process have a volume percentage of 5% to 80%.

12. The method according to claim 1, wherein the dispersant is a polymer dispersant and a non-ion type dispersant, which is least one of alkybenzoyl sulfonate, sulfate, sulfoglycerin phosphate, amino acid salt, phosphatide, taurinate, phosphate, alkysulfate, fatty acid, polyethylene oxide (PEO) thioalcohol, glucitol, and quaternary ammonium.

* * * * *